US009429883B1

(12) United States Patent
Ando

(10) Patent No.: US 9,429,883 B1
(45) Date of Patent: Aug. 30, 2016

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masao Ando, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/936,748

(22) Filed: Nov. 10, 2015

(51) Int. Cl.
*G03G 15/16* (2006.01)
*G03G 13/24* (2006.01)
*G03G 15/24* (2006.01)

(52) U.S. Cl.
CPC ..... *G03G 15/1605* (2013.01); *G03G 13/24* (2013.01); *G03G 15/24* (2013.01); *G03G 2215/0132* (2013.01); *G03G 2215/0135* (2013.01); *G03G 2215/168* (2013.01); *G03G 2215/1676* (2013.01); *G03G 2215/1685* (2013.01); *G03G 2215/1695* (2013.01)

(58) Field of Classification Search
CPC .. G03G 15/24; G03G 15/1605; G03G 13/24; G03G 2215/0132; G03G 2215/0135; G03G 2215/1676; G03G 2215/168; G03G 2215/1685; G03G 2215/1695
See application file for complete search history.

(56) References Cited

U.S. PATENT DOCUMENTS

| | | | | |
|---|---|---|---|---|
| 3,940,210 | A * | 2/1976 | Donohue | G06F 3/002 399/384 |
| 5,453,822 | A * | 9/1995 | Anzai | G03G 15/0126 399/299 |
| 5,797,077 | A * | 8/1998 | Samizo | G03G 15/231 399/298 |
| 5,805,967 | A * | 9/1998 | De Bock | G03G 15/0131 399/299 |
| 5,893,018 | A * | 4/1999 | De Bock | G03G 15/0131 399/302 |
| 6,246,856 | B1 * | 6/2001 | Kopp | G03G 15/231 399/299 |
| 6,345,167 | B1 * | 2/2002 | Bean | G03G 15/232 399/302 |
| 6,556,804 | B1 * | 4/2003 | Lobel | G03G 15/16 399/296 |
| 2002/0064403 | A1 * | 5/2002 | Sakai | G03G 15/238 399/309 |
| 2002/0159801 | A1 * | 10/2002 | Nakashima | G03G 15/101 399/307 |
| 2007/0014596 | A1 * | 1/2007 | Sohmiya | G03G 15/238 399/307 |

FOREIGN PATENT DOCUMENTS

JP 2010-210915 9/2010

* cited by examiner

*Primary Examiner* — Ryan Walsh
(74) *Attorney, Agent, or Firm* — Amin, Turocy & Watson LLP

(57) ABSTRACT

An image forming apparatus comprises a transfer fixer which secondarily transfers a first toner image on a first intermediate transfer belt onto a first side of a sheet at a first secondary transfer position and fixes the first toner image transferred to the first side of the sheet while secondarily transferring a second toner image on the second intermediate transfer belt onto a second side of the sheet opposite to the first side at a second secondary transfer position and fixing the second toner image transferred to the second side of the sheet.

10 Claims, 5 Drawing Sheets

IMAGE FORMING APPARATUS AND IMAGE FORMING METHOD

FIELD

Embodiments described herein relate generally to an image forming apparatus and an image forming method.

BACKGROUND

An image forming apparatus is known which fixes a toner on a sheet. In some cases, the image forming apparatus forms images on two sides of a sheet (double-side printing). At this time, the image forming apparatus forms a first toner image to be transferred on the surface of the sheet. After transferring the first toner image onto the surface of the sheet, the image forming apparatus fixes the first toner image on the surface of the sheet using a fixer. The sheet on which the first toner image is fixed is reversed by a reverser. Then, the image forming apparatus forms a second toner image to be transferred on the back of the sheet. The image forming apparatus receives the sheet fed from the reverser. After transferring the second toner image onto the back of the sheet, the image forming apparatus fixes the second toner image on the back of the sheet using the fixer.

The fixer is equipped with a heat roller and a press roller which heats and presses the toner images while clamping the sheet therebetween.

In double-side printing, the image forming apparatus separately carries out an image formation operation and an image fixation operation twice for a sheet. Thus, double-side printing process is twice as long as single-side printing. Further, the press roller needs to be preheated by the heat roller before the fixer fixes the toner image on a side. Thus, the fixer consumes double power in the double-side printing when compared with that in single-side printing.

Thus, double-side printing, when compared with single-side printing, increases both print time and power consumption.

DETAILED DESCRIPTION

In accordance with an embodiment, an image forming apparatus comprises: a first image forming unit, a second image forming unit, a first intermediate transfer belt, a second intermediate transfer belt, a conveyance unit and a transfer fixer. The first image forming unit forms a first toner image with a first toner with negative charges. The second image forming unit forms a second toner image with a second toner with positive charges. The first intermediate transfer belt is formed into an endless belt. The first toner image is primarily transferred onto the first intermediate transfer belt from the first image forming unit. The first intermediate transfer belt moves the primarily transferred first toner image to a first secondary transfer position. The second intermediate transfer belt is formed into an endless belt opposite to the first intermediate transfer belt. The second toner image is primarily transferred onto the second intermediate transfer belt from the second image forming unit. The second intermediate transfer belt moves the primarily transferred second toner image to a second secondary transfer position opposite to the first secondary transfer position. The conveyance unit conveys a sheet between the first secondary transfer position and the second secondary transfer position. The transfer fixer secondarily transfers the first toner image on the first intermediate transfer belt onto a first side of the sheet at the first secondary transfer position. The transfer fixer fixes the first toner image transferred to the first side of the sheet. Moreover, the transfer fixer secondarily transfers the second toner image on the second intermediate transfer belt onto a second side of the sheet at the second secondary transfer position. The second side is aside opposite to the first side. The transfer fixer fixes the second toner image transferred to the second side of the sheet.

The image forming apparatus and the image forming method disclosed herein are described below with reference to accompanying drawings in which identical reference signs denote identical components unless specified otherwise.

First Embodiment

The image forming apparatus and the image forming method according to the first embodiment are described below.

Figure 1:
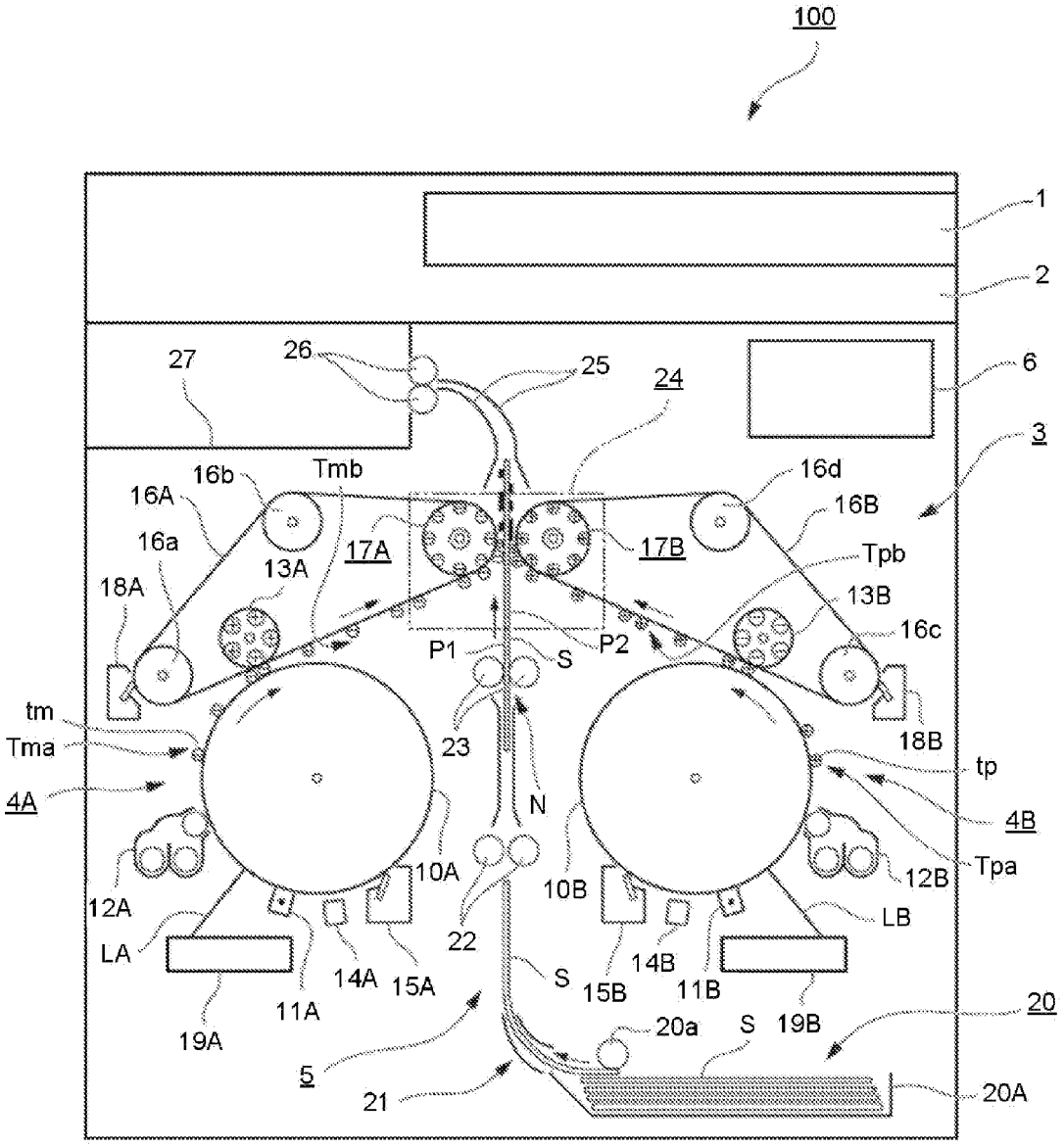
FIG. 1 is a schematic sectional view exemplifying the whole structure of an image forming apparatus according to a first embodiment.
Figure 2:
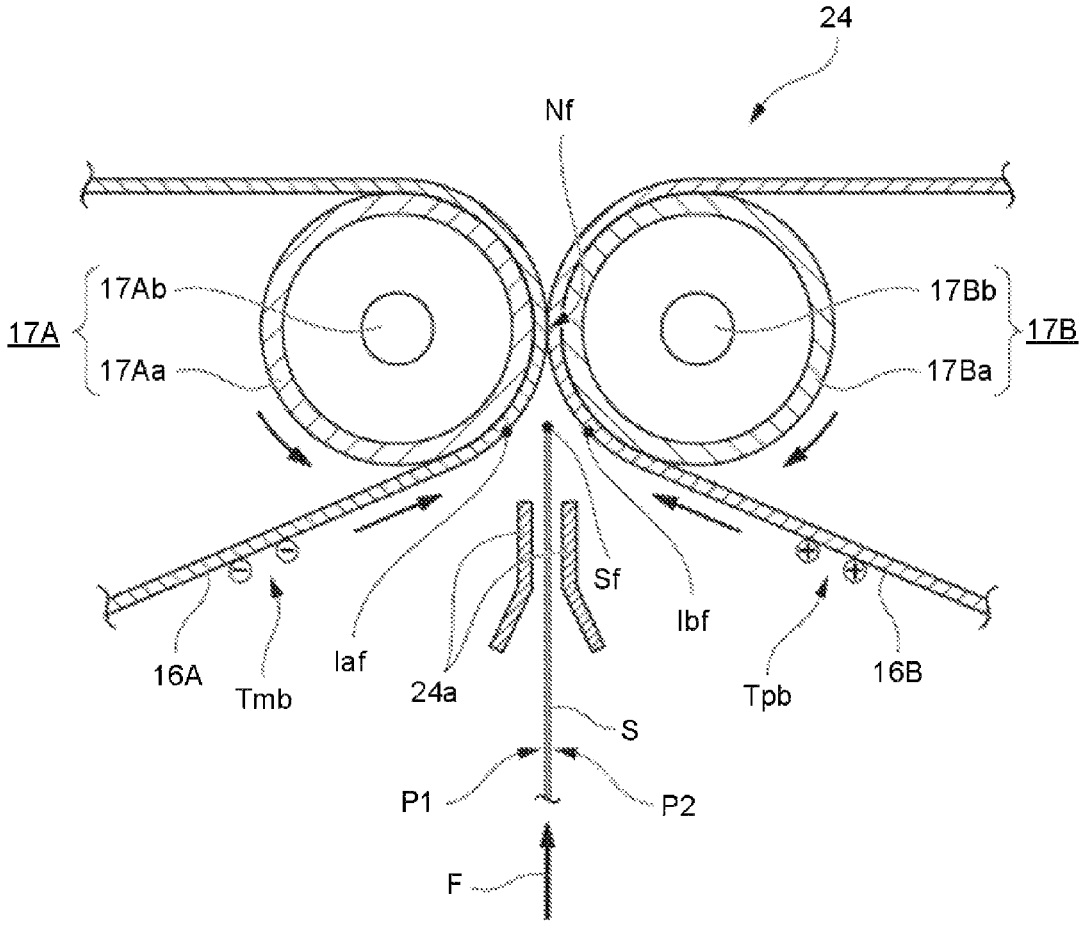
FIG. 2 is a schematic sectional view exemplifying the structure of the transfer fixer of an image forming apparatus according to the first embodiment.
Figure 3:
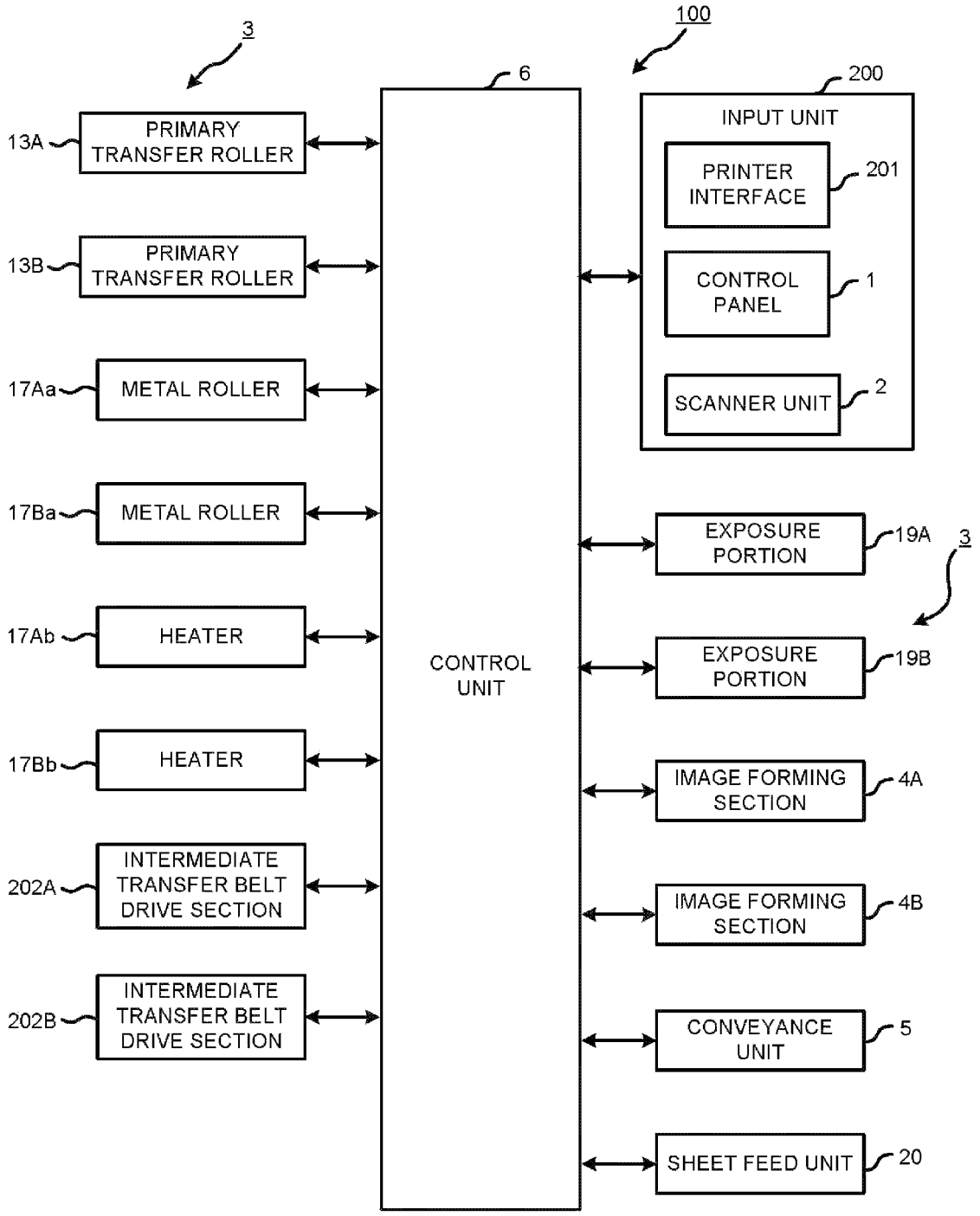
FIG. 3 is a block diagram exemplifying the functional structure of an image forming apparatus according to the first embodiment.

FIG. 1 is a schematic sectional view exemplifying the whole structure of an image forming apparatus according to the first embodiment. FIG. 2 is a schematic sectional view exemplifying the structure of the transfer fixer of an image forming apparatus according to the first embodiment. FIG. 3 is a block diagram exemplifying the functional structure of an image forming apparatus according to the first embodiment.

As shown in FIG. 1, according to the first embodiment, an image forming apparatus 100 comprises a control panel 1, a scanner unit 2, a printer unit 3, a sheet feed unit 20, a conveyance unit 5 and a control unit 6.

The control panel 1 is operated by the user to activate the image forming apparatus 100.

The scanner unit 2 reads the image information of a copied object as light intensity and outputs the read image information to the printer unit 3.

The printer unit 3 forms an output image (hereinafter referred to as a toner image) using a toner-containing developing agent according to the image information received from the scanner section 2 or from the outside.

The printer unit 3 transfers the toner image onto the surface of a sheet S and heats and presses the toner image on the surface of the sheet S to fix the toner image on the sheet S.

The printer unit 3 prints on one or two sides of the sheet S. In single-side printing, an image is formed on either of the surfaces, that is, a first side P1 of the sheet and a second side P2 of the sheet S. In double-side printing, images are synchronously formed on both the surfaces, that is, the first side P1 of the sheet and the second side P2 of the sheet S.

The sheet feed unit 20 feeds sheets S, one by one, to the printer unit 3 matching with the formation of toner images by the printer unit 3. The sheet feed unit 20 is provided with a paper cassette 20A which accommodates sheets S. The sheet S is loaded into the paper cassette 20A with the first side P1 facing down.

The paper cassette 20A is equipped with a paper feed roller 20*a* which picks up sheets S from the paper cassette 20A one by one. The sheet S picked up is conveyed to the conveyance unit 5. In FIG. 1 which is a schematic diagram, the representation of the paper feed roller 20*a* is simplified. The paper feed roller 20*a* includes, for example, a plurality of rollers such as a pickup roller and a separating roller.

In addition to the paper cassette 20A, the sheet feed unit 20 may be equipped with other paper cassettes to feed sheets S of other types and other sizes. The paper feed roller 20*a* is also arranged in the other paper cassettes like in the paper cassette 20A.

The sheet feed unit 20 may further comprise a manual tray and a manual paper feeder.

The conveyance unit 5 comprises a conveyance guider 21, a conveyance roller 22 and a register roller 23. The conveyance guider 21 changes the conveyance path of the sheet S fed from the sheet feed unit 20 to be vertically upward. The conveyance roller 22 is configured above the conveyance guider 21. The conveyance roller 22 conveys the sheet S vertically upwards fed from the conveyance roller 21 along a vertical plane.

The register roller 23 is configured over the conveyance roller 22. The register roller 23 settles the position of the front end of the sheet S. The register roller 23 conveys the position-settled sheet S. The time at which the register roller 23 conveys the sheet is decided by the time at which the printer unit 3 secondarily transfers a toner image onto the sheet S.

The conveyance roller 22 collides the front end of the conveyance direction of the sheet S with the nip N of the register roller 23. The conveyance roller 22 settles the position of the front end of the sheet S in the conveyance direction by curving the sheet S.

The register roller 23 fits the front end of the sheet S in the nip N. Moreover, the register roller 23 vertically conveys the sheet S upwards. The transfer fixer 24 which is described later is located above the register roller 23.

Next, the detailed structure of the printer unit 3 is described below.

The printer unit 3 comprises an image forming section 4A (a first image forming section), an intermediate transfer belt 16A (a first intermediate transfer belt), a transfer belt cleaner 18A, an image forming section 4B (a second image forming section), an intermediate transfer belt 16B (a second intermediate transfer belt), a transfer belt cleaner 18B and a transfer fixer 24.

The image forming section 4A forms a toner image Tma (a first toner image) with a toner tm (a first toner). The toner tm has negative charges. The toner tm, to which no color limitations are given, is exemplarily black in the first embodiment.

The image forming section 4A includes a photoconductive drum 10A which has a photoconductive layer on the surface of the metal drum. The potential of the metal drum is the same as the reference potential of the image forming apparatus 100. The positive/negative polarity of the potential mentioned hereinafter refers to a positive/negative polarity relative to the reference potential of the image forming apparatus 100, if not specified otherwise.

The surface of the photoconductive drum 10A is charged with negative charges by a charger 11A which is described later. If the photoconductive layer is irradiated with light, then the charges of the exposed part are removed.

In the image forming section 4A, a charger 11A, an exposure portion 19A, a developer 12A, a primary transfer roller 13A (a first primary transfer roller), a cleaner 15A and a destaticizer 14A are arranged around the photoconductive drum 10A. The charger 11A, the developer 12A, the primary transfer roller 13A, the cleaner 15A and the destaticizer 14A are orderly arranged along the clockwise direction shown in FIG. 1.

The primary transfer roller 13A is opposite to the photoconductive drum 10A, and the intermediate transfer belt 16A is clamped between the primary transfer roller 13A and the photoconductive drum 16A. The external peripheral surface of the intermediate transfer belt 16A clamped between the primary transfer roller 13A and the photoconductive drum 16A is a first primary transfer position.

The charger 11A charges the surface of the photoconductive drum 10A with negative charges. For example, the charger 11A is a corona discharged charger, a pin electrode charger, a charging roller or the like.

The exposure portion 19A irradiates the surface of the photoconductive drum 10A with exposure light LA which is modulated based on an image signal sent from the scanner unit 2 or the outside. The image signal sent from the scanner unit 2 or the outside to the exposure portion 19A is corresponding to an image formed on the first side P1 of the sheet S.

The exposure portion 19A forms an electrostatic latent image on the photoconductive drum 10A according to the image signal. The irradiation position of the exposure light LA is between the configuration position of the charger 11A and that of the developer 12A which is described later. No specific limitations are given to the configuration position of the exposure portion 19A as long as the exposure light LA from the exposure portion 19A can be transmitted to the irradiation position.

For example, the exposure portion 19A can scan with laser beams. For example, the exposure portion 19A may be a solid scanner which uses an LED light emitting component.

The developer 12A charges the toner tm with negative charges. If the developer 12A applies a development bias voltage, then the electrostatic latent image on the photoconductive drum 10A is developed by the toner tm. The toner tm attached on the photoconductive drum 10A is formed into a toner image Tma according to the electrostatic latent image.

The developer 12A may be a well-known two-component or one-component developer.

The primary transfer roller 13A primarily transfers the toner image Tma attached on the photoconductive drum 10A onto the intermediate transfer belt 16A which is described later. A positive transfer voltage is applied to the primary transfer roller 13A according to the time of the primary transfer. If the positive transfer voltage is applied to the primary transfer roller 13A, then the toner image Tma is primarily transferred onto the intermediate transfer belt 16A from the photoconductive drum 10A.

The cleaner 15A removes the residual toner left on the photoconductive drum 10A and recycles the removed residual toner.

The destaticizer 14A irradiates the surface of the photoconductive drum 10A with light to remove the charges on the surface of the photoconductive drum 10A.

The intermediate transfer belt 16A consisting of an endless belt is arranged above the photoconductive drum 10A. The intermediate transfer belt 16A rotates in synchronization with the photoconductive drum 10A in an opposite rotation direction.

The intermediate transfer belt 16A made from an insulating material is thermally resistive to the fixation temperature of the transfer fixer 24 which is described later. To fix the toner tm on the sheet S, the sheet S is clamped between the intermediate transfer belt 16A and an intermediate transfer belt 16B which is described later. The intermediate transfer belt 16A is pressed towards the intermediate transfer belt 16B. Then, a nip with a width enough for the fixation of the toner tm is formed on the intermediate transfer belt 16A.

The primary transfer roller 13A is propped against the internal peripheral surface of the intermediate transfer belt 16A. The intermediate transfer belt 16A is pressed towards the surface of the photoconductive drum 10A via the primary transfer roller 13A at least during the primary transfer.

Further, a drive roller 16*a* and a transferring and fixing roller 17A are propped against the internal peripheral surface of the intermediate transfer belt 16A with the primary transfer roller 13A clamped therebetween.

The drive roller 16*a* is arranged at the upstream side of the rotation direction of the intermediate transfer belt 16A with respect to the primary transfer roller 13A. The drive roller 16*a* rotationally drives the intermediate transfer belt 16A.

The transferring and fixing roller 17A is arranged at the downstream side of the rotation direction of the intermediate transfer belt 16A with respect to the primary transfer roller 13A.

The drive roller 16*a* and the transferring and fixing roller 17A are driven by an intermediate transfer belt drive section 202A (refer to FIG. 3).

The intermediate transfer belt drive section 202A comprises a drive motor (not shown) and a drive transmission portion (not shown). The intermediate transfer belt drive section 202A matches the rotation direction and the rotational linear velocity with those of the transferring and fixing roller 17A and the drive roller 16*a*.

The transferring and fixing roller 17A is arranged on the side of the first side P1 of the sheet S conveyed by the register roller 23. The transferring and fixing roller 17A is opposite to the first side P1 of the sheet S across the intermediate transfer belt 16A.

The transferring and fixing roller 17A constitutes one part of the transfer fixer 24 which is described later. The detailed structure of the transferring and fixing roller 17A is described later.

The drive roller 16*a* and the transferring and fixing roller 17A stretch the intermediate transfer belt 16A. A tension roller 16*b* is propped against the internal peripheral surface of the intermediate transfer belt 16A between the drive roller 16*a* and the transferring and fixing roller 17A. The internal peripheral surface propped against the tension roller 16*b* is a side (the upper side shown in FIG. 1) opposite to the internal peripheral surface propped against the primary transfer roller 13A.

The tension roller 16*b* presses the internal peripheral surface of the intermediate transfer belt 16A outwards. The tension roller 16*b* keeps the tension of the intermediate transfer belt 16A fixed.

The transfer belt cleaner 18A is arranged on the external periphery of the intermediate transfer belt 16A. The transfer belt cleaner 18A is opposite to the drive roller 16*a*, and the intermediate transfer belt 16A is clamped between the transfer belt cleaner 18A and the drive roller 16*a*.

The transfer belt cleaner 18A removes the residual toner left on the external periphery of the intermediate transfer belt 16A and recycles the residual toner.

The image forming section 4B forms a toner image Tpa (a second toner image) with a toner tp (a second toner) with positive charges. The toner tp, to which no color limitations are given, has the same color with the toner tm in the first embodiment.

The image forming section 4B includes a photoconductive drum 10B which has a photoconductive layer on the surface of the metal drum thereof. The potential of the metal drum is the same as the reference potential of the image forming apparatus 100.

The surface of the photoconductive drum 10B is charged with positive charges by a charger 11B which is described later. If the photoconductive layer is irradiated with light, then the charges of the exposed part are removed.

In the image forming section 4B, a charger 11B, an exposure portion 19B, a developer 12B, a primary transfer roller 13B (a second primary transfer roller), a cleaner 15B and a destaticizer 14B are arranged around the photoconductive drum 10B. The charger 11B, the developer 12B, the primary transfer roller 13B, the cleaning portion 15B and the destaticizer 14B are orderly arranged along the counter-clockwise direction shown in FIG. 1.

The primary transfer roller 13B is opposite to the photoconductive drum 10B, and the intermediate transfer belt 16B is clamped between the primary transfer roller 13B and the photoconductive drum 10B. The position where the external peripheral surface of the intermediate transfer belt 16B is clamped between the primary transfer roller 13B and the photoconductive drum 10B is a second primary transfer position.

The charger 11B charges the surface of the photoconductive drum 10B with positive charges. For example, the charger 11B is a corona discharged charger, a pin electrode charger, a charging roller or the like.

The exposure portion 19B irradiates the surface of the photoconductive drum 10B with exposure light LB which is modulated based on an image signal sent from the scanner unit 2 or the outside. The image signal sent from the scanner unit 2 or the outside to the exposure portion 19B is corresponding to an image formed on the second side P2 of the sheet S.

The exposure portion 19B forms an electrostatic latent image on the photoconductive drum 10B according to the image signal. The irradiation position of the exposure light LB is between the configuration position of the charger 11B and that of the developer 12B which is described later. No specific limitations are given to the configuration position of the exposure portion 19B as long as the exposure light LB from the exposure portion 19B can be transmitted to the irradiation position.

The exposure portion 19B is structurally identical to the exposure portion 19A except for part placement.

The developer 12B charges the toner tp with positive charges. If the developer 12B applies a development bias voltage, then the electrostatic latent image on the photoconductive drum 10B is developed by the toner tp. The toner tp attached on the photoconductive drum 10B is formed into a toner image Tpa according to the electrostatic latent image.

The developer 12B may be a well-known two-component or one-component developer.

The primary transfer roller 13B primarily transfers the toner image Tpa attached on the photoconductive drum 10B onto the intermediate transfer belt 16B which is described later. A negative transfer voltage is applied to the primary transfer roller 13B according to the time of the primary transfer. If the negative transfer voltage is applied to the primary transfer roller 13B, then the toner image Tpa is primarily transferred onto the intermediate transfer belt 16B from the photoconductive drum 10B.

The cleaner 15B removes the residual toner left on the photoconductive drum 10B and recycles the removed residual toner.

The destaticizer 14B irradiates the surface of the photoconductive drum 10B with light to remove the charges on the surface of the photoconductive drum 10B.

The intermediate transfer belt 16B consisting of an endless belt is arranged above the photoconductive drum 10B. The intermediate transfer belt 16B rotates in synchronization with the photoconductive drum 10B in an opposite rotation direction.

The intermediate transfer belt 16B made from an insulating material is thermally resistive to the fixation temperature of the transfer fixer 24 which is described later. The intermediate transfer belt 16B has elasticity. To fix the toner tp on the sheet S, the sheet S is clamped between the intermediate transfer belt 16B and an intermediate transfer belt 16A. The intermediate transfer belt 16B is pressed towards the intermediate transfer belt 16A. Then, a nip with a width enough for the fixation of the toner tp is formed on the intermediate transfer belt 16B.

The primary transfer roller 13B is propped against the internal peripheral surface of the intermediate transfer belt 16B. The intermediate transfer belt 16B is pressed towards the surface of the photoconductive drum 10B via the primary transfer roller 13B at least during the primary transfer.

Further, a drive roller 16*c* and a transferring and fixing roller 17B are propped against the internal peripheral surface of the intermediate transfer belt 16B with the primary transfer roller 13B clamped therebetween.

The drive roller 16*c* is arranged at the upstream side of the rotation direction of the intermediate transfer belt 16B with respect to the primary transfer roller 13B. The drive roller 16*c* rotationally drives the intermediate transfer belt 16B.

The transferring and fixing roller 17B is arranged at the downstream side of the rotation direction of the intermediate transfer belt 16B with respect to the primary transfer roller 13B.

The drive roller 16*c* and the transferring and fixing roller 17B are driven by an intermediate transfer belt drive section 202B (refer to FIG. 3).

The intermediate transfer belt drive section 202B comprises a drive motor (not shown) and a drive transmission portion (not shown). The intermediate transfer belt drive section 202B matches the rotation direction and the rotational linear velocity with those of the transferring and fixing roller 17B and the drive roller 16*c*.

The transferring and fixing roller 17B is arranged on the side of the second side P2 of the sheet S conveyed by the register roller 23. The transferring and fixing roller 17B is opposite to the second side P2 of the sheet S across the intermediate transfer belt 16B.

Further, the transferring and fixing roller 17B is opposite to the transferring and fixing roller 17A, and the intermediate transfer belts 16B and 16A are clamped between the transferring and fixing rollers 17A and 17B. The transferring and fixing rollers 17A and 17B are opposite to each other in the horizontal direction vertical to the conveyance direction of the sheet.

The transferring and fixing rollers 17B and 17A together constitute one part of the transfer fixer 24 which is described later. The detailed structure of the transferring and fixing roller 17B is described later.

The drive roller 16*c* and the transferring and fixing roller 17B stretch the intermediate transfer belt 16B. A tension roller 16*d* is propped against the internal peripheral surface of the intermediate transfer belt 16B between the drive roller 16*c* and the transferring and fixing roller 17B. The internal peripheral surface propped against the tension roller 16*d* is a side (the upper side shown in FIG. 1) opposite to the internal peripheral surface propped against the primary transfer roller 13B.

The tension roller 16*d* presses the internal peripheral surface of the intermediate transfer belt 16B outwards. The tension roller 16*d* keeps the tension of the intermediate transfer belt 16B fixed.

The transfer belt cleaner 18B is arranged on the external periphery of the intermediate transfer belt 16B. The transfer belt cleaner 18B is opposite to the drive roller 16*c*, and the intermediate transfer belt 16B is clamped between the transfer belt cleaner 18B and the drive roller 16*c*.

The transfer belt cleaner 18B removes the residual toner left on the external periphery of the intermediate transfer belt 16B and recycles the residual toner.

The transfer fixer 24 secondarily transfers the toner image Tmb on the intermediate transfer belt 16A onto the first side P1 of the sheet S and fixes the secondarily transferred toner image Tmb on the first side P1 of the sheet S. Moreover, the transfer fixer 24 secondarily transfers the toner image Tpb on the intermediate transfer belt 16B onto the second side P2 of the sheet S. The transfer fixer 24 fixes the secondarily transferred toner image Tpb on the second side P2 of the sheet S.

The toner image Tmb and the toner image Tpb are secondarily transferred and fixed at the same time in the transfer fixer 24.

As shown in FIG. 2, the transfer fixer 24 comprises: transferring and fixing rollers 17A and 17B and intermediate transfer belts 16A and 16B passing between the transferring and fixing rollers 17A and 17B. The intermediate transfer belts 16A and 16B passing between the transferring and fixing rollers 17A and 17B are pressed by the transferring and fixing rollers 17A and 17B in opposite directions. Thus, the intermediate transfer belts 16A and 16B are deformed. A nip Nf is formed between the intermediate transfer belts 16A and 16B.

The nip Nf extends along the length direction of the transferring and fixing rollers 17A and 17B.

On the nip Nf, the surface of the intermediate transfer belt 16A is the first secondary transfer position where the toner image Tmb is secondarily transferred onto the first side P1 of the sheet S. Moreover, on the nip Nf, the surface of the intermediate transfer belt 16B is the second secondary transfer position where the toner image Tpb is secondarily transferred onto the second side P2 of the sheet S.

The path between the first primary transfer position and the first secondary transfer position which may not be as long as the path between the second primary transfer position and the second secondary transfer position is, however, as long as the path between the second primary transfer position and the second secondary transfer position in the image forming apparatus 100.

Besides, the nip Nf is also an area in which the toner image Tpb is fixed on the second side P2 of the sheet S while the toner image Tmb is fixed on the first side P1 of the sheet S.

The width of the nip Nf in the conveyance direction F of sheet S is width within which the toner images Tmb and Tpb can be heated and pressurized to be synchronously fixed.

A conveyance guider 24*a* for guiding the conveyance of the sheet S is arranged below the nip Nf to guide the sheet S on a vertical plane passing the nip Nf.

Thermally insulating covers (not shown) may also be arranged around the transferring and fixing rollers 17A ad 17B and the intermediate transfer belts 16A and 16B. The thermally insulating covers are arranged at proper positions so as not to obstruct the conveyance of the sheet S.

The transferring and fixing roller 17A comprises a metal roller 17Aa and a heater 17Ab.

The metal roller 17Aa is formed into a hollow cylinder. The metal roller 17Aa is rotated by the intermediate transfer belt drive section 202A (not shown) in the counterclockwise direction shown in FIG. 2. The metal roller 17Aa is rotated in synchronization with the drive roller 16*a*.

Pressure springs (not shown) are arranged at two ends of the metal roller 17Aa in the length direction of the metal roller 17Aa to press the metal roller 17Aa towards a metal roller 17Ba.

A negative transfer voltage is applied to the metal roller 17Aa. If the negative transfer voltage is applied to the metal roller 17Aa, then the toner image Tmb is secondarily transferred onto the sheet S. The application of a voltage to the metal roller 17Aa is controlled by the control unit 6 which is described later.

The control unit 6 secondarily transfers the toner image Tmb by applying a negative transfer voltage to the metal roller 17Aa.

The metal roller 17Aa is made of a metal having excellent conductivity. The higher the thermal conductivity of the metal roller 17Aa is, the better the metal roller 17Aa is. For example, the metal roller 17Aa is made from aluminum alloy, ferrous alloy or copper alloy.

The metal roller 17Aa is propped against the intermediate transfer belt 16A serving as an insulator. It is not needed to coat the surface of the metal roller 17Aa with an insulating coat.

However, the surface of the metal roller 17Aa may be coated with various coatings. For example, a coating may be coated on the surface of the metal roller 17Aa to change the frictional property between the surface of the metal roller 17Aa and the intermediate transfer belt 16A. For example, a protective coating may be coated on the surface of the metal roller 17Aa to reduce the abrasion caused by the intermediate transfer belt 16A.

The heater 17Ab heats the metal roller 17Aa. The quantity of the heat emitted from the heater 17Ab is controlled by the control unit 6 which is described later. During a fixation process, the control unit 6 at least controls the temperature of the nip Nf to be a temperature needed for the fixation of the toner image Tmb.

The heater 17Ab may be, for example, a halogen heater lamp, an induction heater (IH) or the like.

The transferring and fixing roller 17B comprises a metal roller 17Ba and a heater 17Bb.

The metal roller 17Ba and the heater 17Bb are structurally identical to the metal roller 17Aa and the heater 17Ab of the transferring and fixing roller 17A.

However, the metal roller 17Ba is rotated by the intermediate transfer belt drive section 202B (not shown) in the clockwise direction shown in FIG. 2. The metal roller 17Ba is rotated in synchronization with the drive roller 16*c*.

Besides, the metal roller 17Ba rotates at the same speed with the metal roller 17Aa.

Pressure springs (not shown) are arranged at two ends of the metal roller 17Ba in the length direction of the metal roller 17Ba. The pressure springs press the metal roller 17Ba towards the metal roller 17Aa.

A positive transfer voltage is applied to the metal roller 17Ba. If the positive transfer voltage is applied to the metal roller 17Ba, then the toner image Tpb is secondarily transferred onto the sheet S. The application of a voltage to the metal roller 17Ba is controlled by the control unit 6.

The control unit 6 secondarily transfers the toner image Tpb by applying a positive transfer voltage to the metal roller 17Ba.

The heater 17Bb heats the metal roller 17Ba. The quantity of the heat emitted from the heater 17Bb is controlled by the control unit 6 which is described later. During a fixation process, the control unit 6 at least controls the temperature of the nip Nf to be a temperature needed for the fixation of the toner image Tpb.

In the image forming apparatus 100, the exposure position of the exposure line LA, the first primary transfer position and the first secondary transfer position are set on an image formation path at predetermined intervals. Moreover, the exposure position of the exposure line LB, the second primary transfer position and the second secondary transfer position are set on the image formation path according to the same relative position relation.

The printer unit 3 further comprises a paper discharging guider 25, a paper discharging roller 26 and a paper discharging tray 27.

The paper discharging guider 25 changes the conveyance direction of the fixed sheet S.

The fixed sheet S is vertically moved upwards towards the paper discharging guider 25 via the transfer fixer 24. In the image forming apparatus 100, the paper discharging guider 25 changes the conveyance direction of the fixed sheet S into a horizontal direction.

The paper discharging roller 26 discharges the sheet S passing the paper discharging guiders 25 onto the paper discharging tray 27.

The paper discharging tray 27 holds the sheet S discharged from the paper discharging roller 26. In an embodiment, the paper discharging tray 27 positioned above the image forming section 4A horizontally holds the sheets S.

As shown in FIG. 3, the control unit 6 is connected with each unit of the image forming apparatus 100 in a communicable manner so as to control each unit of the image forming apparatus 100.

The control carried out by the control unit 6 includes: the control on the scanner unit 2, the control on the printer unit 3 and the control on the feed, the conveyance and the discharging of the sheet S.

The control unit 6 is connected with an input unit 200, the printer unit 3, the conveyance unit 5 and the sheet feed unit 20 in a communicable manner. The control unit 6 controls an image formation action based on an instruction input from the input unit 200.

The input unit 200 comprises: a printer interface 201, the foregoing control panel 1 and the foregoing scanner unit 2.

The printer interface 201 is an interface serving when the image forming apparatus 100 functions as a printer. The printer interface 201 is connected with a communication line to send, via the communication line, an action instruction given from the image forming apparatus 100 and an image signal to be printed to the control unit 6.

The control unit 6 controls actions of the exposure portion 19A and the image forming section 4A based on the one of the image signals input from the input unit 200 which indicates that a printing operation is to be implemented on the first side P1 of the sheet S.

Meanwhile, the control unit 6 controls actions of the exposure portion 19B and the image forming section 4B based on the one of the image signals input from the input unit 200 which indicates that a printing operation is to be implemented on the second side P2 of the sheet S.

The control unit 6 drives the drive rollers 16*a* and 16*c* and the metal rollers 17Aa and 17Ba through the intermediate transfer belt drive sections 202A and 202B.

The control unit 6 controls the transfer voltages applied to the primary transfer rollers 13A and 13B and the metal rollers 17Aa and 17Ba and the application time of the transfer voltages.

The control unit 6 changes the amount of the heat emitted from the heaters 17Ab and 17Bb based on an output from a temperature sensor (not shown) to control the temperature of the nip Nf.

The detailed content of the control carried out by the control unit 6 and the actions of the image forming apparatus 100 are described below together.

The control unit 6 structurally consists of proper hardware and a computer equipped with a CPU, a memory, an input/output interface and an external memory. The control unit 6 enables the computer to execute a control program to realize the foregoing control function. Alternatively, the control unit 6 activates the proper hardware to realize the foregoing control function.

The image forming apparatus 100 with the foregoing structure is an apparatus using an image forming method of the first embodiment. The actions of the image forming apparatus 100 are described below centering on those related to the image forming method of the first embodiment.

Figure 4:
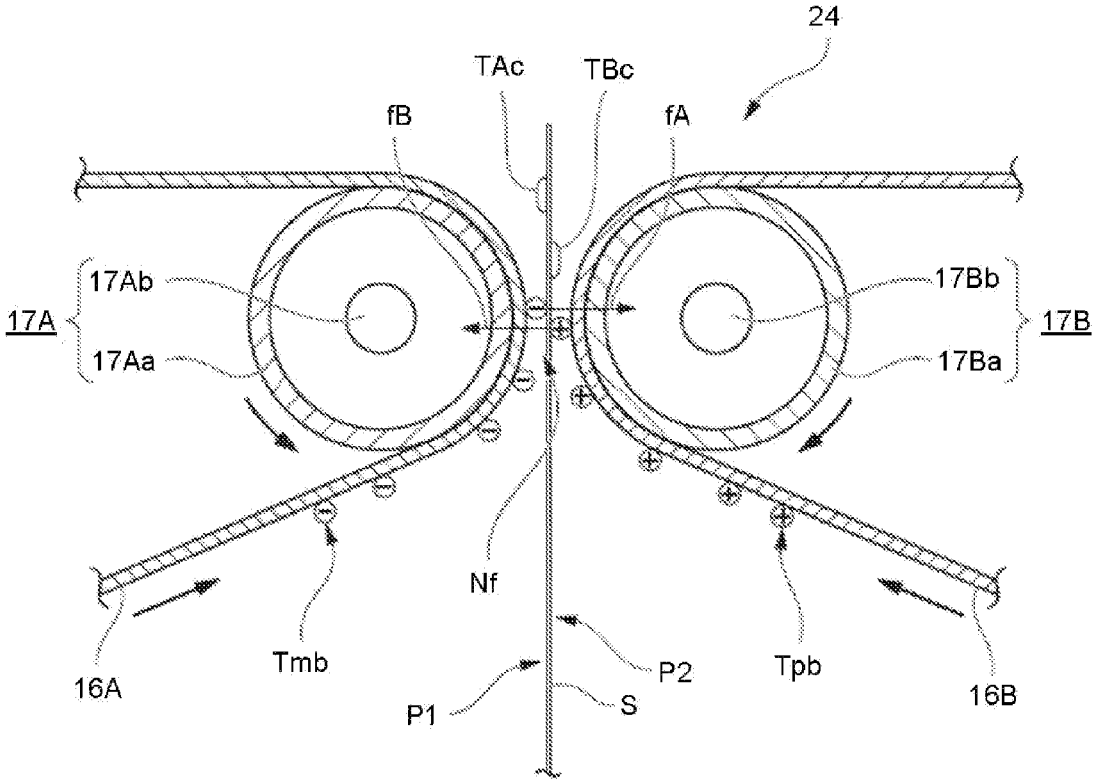
FIG. 4 is a schematic sectional view illustrating the actions of the transfer fixer of an image forming apparatus according to the first embodiment.

FIG. 4 is a schematic sectional view illustrating the actions of the transfer fixer of an image forming apparatus according to the first embodiment.

In the image forming apparatus 100, an image formation instruction is input to the control unit 6 from the control panel 1 or the outside.

The control unit 6 determines to implement a single-side printing or a double-side printing based on an instruction from the input unit 200.

A double-side printing action is described below first. A single-side printing action is described later.

In double-side printing, the image forming apparatus 100 forms an image on the surfaces, that is, a first side 21 of the sheet S and a second side P2 of the sheet S. In the image forming apparatus 100, the front ends of the images formed by the image forming sections 4A and 4B, after being primarily transferred, reach the nip Nf synchronously.

If the control unit 6 receives an image formation starting instruction from the input unit 200, then a sheet is fed and conveyed by the sheet feed unit 20 and the conveyance unit 5. The front end of the sheet reaching the register roller 23 is settled at a nip N.

After the front end of the sheet is settled at a nip N, the control unit 6 starts the image formation in the image forming sections 4A and 4B. The image formation process in the image forming section 4A is merely different from the image formation process in the image forming section 4B in charge characteristics of the toners tm and tp.

The following actions are carried out under the control of the control unit 6.

The photoconductive drum 10A (10B) is rotated in the clockwise (counterclockwise) direction. The charger 11A (11B) charges the surface of the photoconductive drum 10A (10B) with the negative (positive) charges. The exposure unit 19A (19B) illuminates the surface of the photoconductive drum 10A (10B) with exposure light LA (LB) modulated based on an image signal. The charges of the part exposed by the exposure light LA (LB) are removed according to the quantity of illumination. The potential of the part exposed by the exposure light LA (LB) is changed from a charged potential to an exposed potential. In this way, an electrostatic latent image is formed on the surface of the photoconductive drum 10A (10B) based on the image signal.

The time at which the front end of the image is allowed to be exposed is marked as time t0. The position of the photoconductive drum 10A (10B) at which the exposure light LA (LB) arrives at t0 is the front end of an image formation range.

The developer 12A (12B) develops the electrostatic latent image formed with the toner tm (tp). The toner tm (tp) is attached on the part of the photoconductive drum 10A (10B) where the potential is changed after an exposure. A toner image Tma (Tpa) is formed on the surface of the photoconductive drum 10A (10B) with the toner tm (tp).

The front end of the image formation range on the photoconductive drum 10A (10B) arrives at a first (second) primary transfer position after a given time elapses from t0. The time of the arrival of the front end of the image formation range on the photoconductive drum 10A (10B) at the first (second) primary transfer position is marked as t1 (t1>t0).

On the other hand, the drive roller 16*a* (16*c*) and the transferring and fixing roller 17A (17B) are driven by the intermediate transfer belt drive section 202A (202B). Thus, the intermediate transfer belt 16A (16B) rotates at the same linear speed in an opposite direction with respect to the photoconductive drum 10A (10B).

The quantity of the heat emitted from the heater 17Ab (17Bb) is controlled by the control unit 6. The heater 17Ab (17Bb) heats the metal roller 17Aa (17Ba). The heater 17Ab (17Bb) heats the intermediate transfer belt 16A (16B) propped against the metal roller 17Aa (17Ba) via the metal roller 17Aa (17Ba). The temperature of the nip Nf is a preset fixation temperature.

At this time, the metal roller 17Aa and the intermediate transfer belt 16A in the area of the nip Nf are mainly heated by the heater 17Ab. The metal roller 17Ba and the intermediate transfer belt 16B in the area of the nip Nf are mainly heated by the heater 17Bb.

For example, in the case where the fixer consists of a heat roller and a press roller, the heat of the heater in the heat roller is transferred to the press roller via the nip. The heat roller heats the press roller provided with no heat source. To stabilize the fixation temperature of the nip, it is needed to increase the temperature of the press roller to be equal to that of the heat roller. Apart from being consumed to melt a toner, the heat energy of the heat roller is also consumed to increase the temperature of the press roller and maintain the temperature of the press roller. As the press roller has a relatively large heat capacity, the heat energy consumed to increase the temperature of the press roller and maintain the temperature of the press roller is relatively large.

However, in the image forming apparatus 100 not equipped with a press roller having no heat source, the heaters 17Ab and 17Bb need not to heat a press roller. Thus, the power totally consumed by the heaters 17Ab and 17Bb is less than that consumed by the heater of a fixer consisting of a heat roller and a press roller.

A positive (negative) transfer voltage is applied to the primary transfer roller 13A (13B) when the front end of the image formation range reaches the first (second) primary transfer position (time t1). The toner image Tma (Tpa) of the photoconductive drum 10A (10B) is charged with negative (positive) charges. The primary transfer roller 13A (13B) primarily transfers the toner image Tma (Tpa) onto the intermediate transfer belt 16A (16B). The toner image Tma (Tpa) is moved orderly on the intermediate transfer belt 16A (16B) to successively form the toner image Tmb (Tpb).

The residual toner left on the surface of the photoconductive drum 10A (10B) on which the toner image Tma (Tpa) are transferred is removed by the cleaner 15A (15B). The removed residual toner is recycled into the cleaner 15A (15B).

The photoconductive drum 10A (10B) is irradiated by light emitted from the destaticizer 14A (14B) so that the residual charges on the photoconductive drum 10A (10B) are removed.

The photoconductive drum 10A (10B) carries out the foregoing image formation action repeatedly.

On the other hand, the toner image Tmb (Tpb) transferred to the intermediate transfer belt 16A (16B) is moved together with the intermediate transfer belt 16A (16B).

As shown in FIG. 2, the front ends Iaf and Ibf of the image formation ranges in the intermediate transfer belts 16A and 16B are close to and the same path length from the nip Nf. The time of the arrival of the front ends Iaf and Ibf of the image formation ranges at the nip Nf is marked as time t3 (t3>t2).

The control unit 6 drives the register roller 23 at ts in a range from the time t0 to the time t3. The sheet S settled at the nip N of the register roller 23 is conveyed towards the transfer fixer 24.

The time ts is the moment at which the front end Sf of the sheet S starts to be conveyed so that the front end Sf reaches the nip Nf at the moment t3', wherein $t3'=t3-\Delta t$ ($\Delta t>0$), in which $\Delta t$ is the conveyance error of the sheet S as well as the time needed for the formation of a margin on the front end of the sheet S.

Thus, the front end Sf of the sheet S is slightly clamped on the nip Nf at the time t3.

The control unit 6 starts to apply a negative (positive) transfer voltage to the metal roller 17Aa (17Ba) before the moment t3'. If the metal roller 17Aa (17Ba) is applied with the transfer voltage, then an electric field is generated between the metal rollers 17Aa and 17Ba. The direction of the electric field is from the metal roller 17Ba to the metal roller 17Aa.

After the time t3, the toner image Tmb, the sheet S and the toner image Tpb are orderly clamped between the intermediate transfer belts 16A and 16B, as shown in FIG. 4.

The toner image Tmb with negative charges accepts an external force fA applied from the electric field between the metal rollers 17Aa and the 17Ba towards the first side P1 so that the toner image Tmb is transferred onto the first side P1.

The toner image Tpb with positive charges accepts an external force fB applied from the electric field between the metal rollers 17Aa and the 17Ba towards the second side P2 so that the toner image Tpb is transferred onto the second side P2.

Such a secondary transfer is started from an area nearby the nip Nf according to the magnitude of a transfer voltage.

On the other hand, the heat applied to the toner images Tmb and Tpb increases as the toner images Tmb and Tpb approaches the nip Nf. The toner images Tmb and Tpb are orderly softened.

In the nip Nf, the toner images Tmb and Tpb clamped by the intermediate transfer belts 16A and 16B are heated to a fixation temperature while being pressurized. Thus, the toner images Tmb and Tpb are melted in the nip Nf. The melted toner images Tmb and Tpb are fixed on the sheet S under the pressure in the nip Nf.

The sheet S is moved upwards from the nip Nf as the transferring and fixing rollers 17A and 17B are rotated. In this case, a fixed toner image TAc resulting from the fixation of the toner image Tmb is formed on the first side P1 of the sheet S, and a fixed toner image TBc resulting from the fixation of the toner image Tpb is formed on the second side P2 of the sheet S.

As shown in FIG. 1, the sheet S pulled off the transfer fixer 24 is changed in conveyance direction by the paper discharging guider 25. Once reaching the front end of the paper discharging guider 25, the sheet S is discharged to the paper discharging tray 27 by the paper discharging roller 26. In the image forming apparatus 100, the sheet S is discharged with the first side P1 thereof facing the bottom side of the paper discharging tray 27.

At this time, fixed toner images TAc and TBc are formed on the first side P1 and the second side P2 of the sheet S corresponding to image signals.

The above is description on double-side printing.

Then, a single-side printing action is described below.

In the image forming apparatus 100, single-side printing is implemented by stopping the image formation action of the one of the image forming sections 4A and 4B which is not required to form an image. Which one of the image forming sections 4A and 4B is used to form an image can be selected through the input unit 200. Alternatively, an image is formed by a fixed one of the image forming sections 4A and 4B.

As an example, in the image forming apparatus 100, only the image forming section 4A is used for single-side printing.

The single-side printing of the mage forming apparatus 100 is described below centering on the difference from double-side printing.

In single-side printing, the control unit 6 stops all the actions of the image formation section 4B, including rotating the photoconductive drum 10B. In single-side printing, the intermediate transfer belt drive section 202B implements the same action as that in double-side printing. However, the primary transfer roller 13B is freed from pressing the photoconductive drum 10B. Thus, the intermediate transfer belt 16B is not contacted with the photoconductive drum 10B.

The control unit 6 applies no transfer voltage to the primary transfer roller 13B.

In single-side printing, the transfer voltage is applied to the metal roller 17Ba in the same way as that in double-side printing.

The control unit 6 reduces the quantity of the heat emitted from the heater 17Bb in single-side printing.

In single-side printing, it is not needed to melt the toner image on the second side P2. Moreover, the heater 17Bb only needs to heat the intermediate transfer belt 16B which is in close contact with the metal roller 17Ba having excellent thermal conductivity. Thus, the temperature of the intermediate transfer belt 16B rises faster when compared with a case where a heater heats a press roller having a large thermal capacity from a nip. Thus, the temperature of the nip Nf can be kept at a proper fixation temperature even if the quantity of the heat emitted from the heater 17Bb is reduced.

As stated above, the image forming apparatus 100 can print on both sides of a sheet S by causing the sheet S to pass the transfer fixer 24 once. Thus, the image forming apparatus 100 spends as much time in completing double-side printing as in completing single-side printing. In the image forming apparatus 100, the time taken to reverse a sheet S one side of which is printed is saved. Thus, the time spent by the image forming apparatus 100 in completing double-side printing is half of that spent by the image forming apparatus 100 in the case where a sheet S passes a fixer twice.

Further, the transferring and fixing rollers 17A and 17B of the image forming apparatus 100 are equipped with heaters 17Ab and 17Bb, respectively. Thus, in both double-side printing and single-side printing, the power consumption of the image forming apparatus 100 is reduced when compared with the case where a heat roller and a press roller are combined in a fixer. Especially, the power consumption of the image forming apparatus 100 is nearly reduced by half in double-side printing.

Further, in the image forming apparatus 100, secondary transfer and fixation are synchronously carried out in the transfer fixer 24. Thus, the apparatus is smaller than an apparatus in which secondary transfer and fixation are carried out in different units. Further, as the transferring and fixing rollers 17A and 17B additionally function as secondary transfer rollers and fixing rollers, the number of components is reduced.

In the image forming apparatus 100, transfer voltages which are opposite in polarity are applied to the metal rollers 17Aa and 17Ba, respectively. The toner image Tmb is transferred by a repulsive force from the metal roller 17Aa in combination with an attractive force from the metal roller 17Ba. The toner image Tpb is transferred by a repulsive force from the metal roller 17Ba in combination with an attractive force from the metal roller 17Aa.

Thus, the toner images Tmb and Tpb can be secondarily transferred effectively, thus preventing an uneven transfer.

In the image forming apparatus 100, as the image forming section 4B is stopped in single-side printing, the power consumed in single-side printing is reduced when compared to that consumed in double-side printing.

Second Embodiment

The image forming apparatus of a second embodiment is described.

Figure 5:
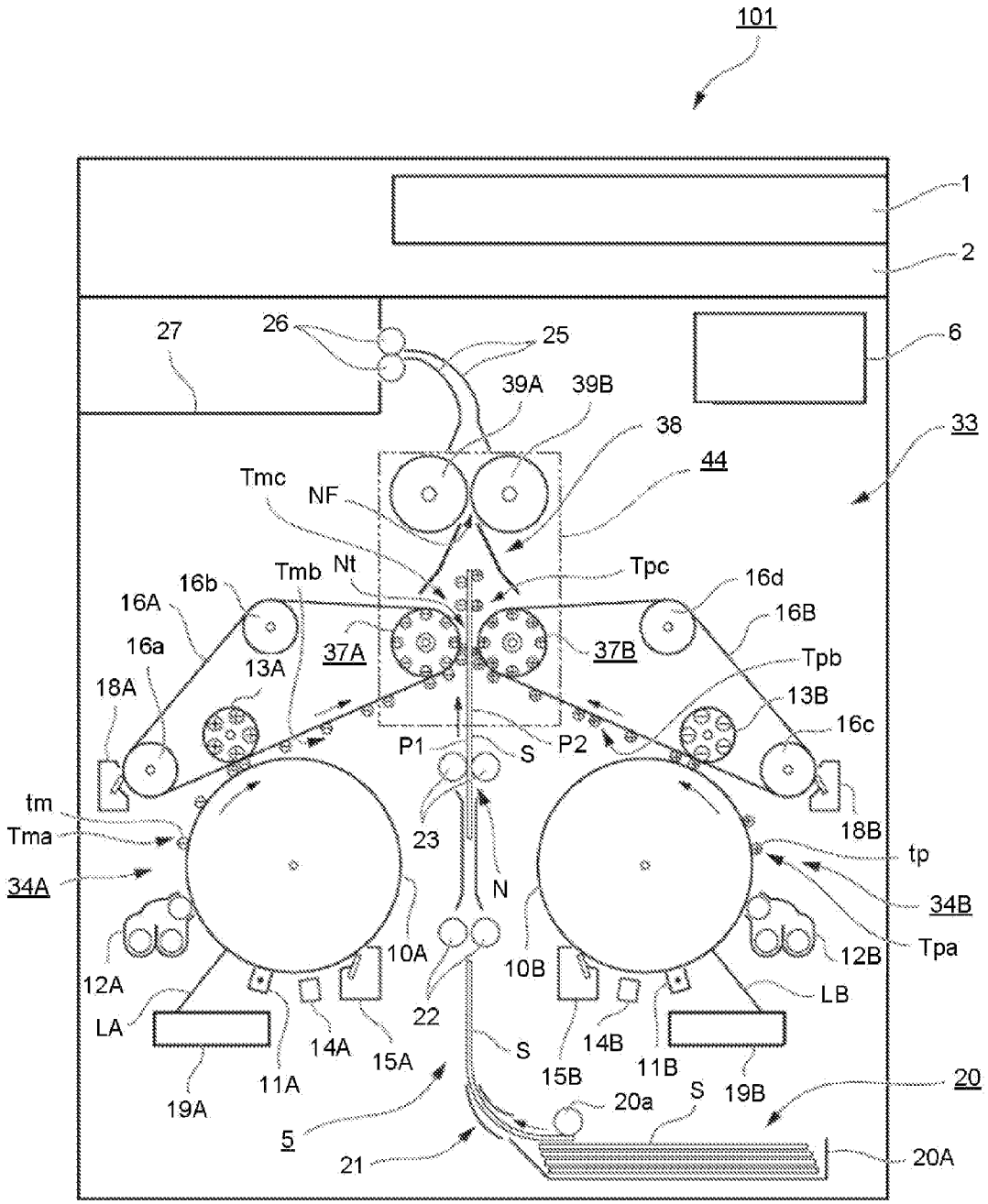
FIG. 5 is a schematic sectional view exemplifying the whole structure of an image forming apparatus according to a second embodiment.

FIG. 5 is a schematic sectional view exemplifying the whole structure of an image forming apparatus according to the second embodiment.

As shown in FIG. 5, the transfer fixer 24 of the image forming apparatus 100 of the first embodiment is replaced by a transfer fixer 44 in the image forming apparatus 101 of the foregoing the second embodiment.

The transferring and fixing rollers 17A and 17B in the transfer fixer 24 are replaced by secondary transfer rollers 37A and 37B in the transfer fixer 44. Moreover, the transfer fixer 44 comprises an inlet guider plate 38 and fixing rollers 39A and 39B.

The second embodiment is described below centering on the difference from the first embodiment.

The secondary transfer roller 37A (37B) secondarily transfers the toner image Tmb (Tpb) onto the first side P1 (the second side P2) of the sheet S. If the toner image Tmb (Tpb) is secondarily transferred, then a toner image Tmc (Tpc) is formed on the first side P1 (second side P2).

The secondary transfer roller 37A (37B) is applied with a negative (positive) transfer voltage corresponding to the time of the secondary transfer.

The secondary transfer rollers 37A and 37B may be structured by deleting the heaters 17Ab and 17Bb from the transferring and fixing roller 17A and 17B of first embodiment. However, the secondary transfer roller 37A (37B) is not limited to be structured like this. For example, the secondary transfer roller 37A (37B) may be a well-known secondary transfer roller which applies a secondary transfer voltage from the inner side of an intermediate transfer belt.

The secondary transfer rollers 37A and 37B are arranged opposite to each other, like the transferring and fixing rollers 17A and 17B. The secondary transfer rollers 37A and 37B press each other in opposite directions, like the transferring and fixing rollers 17A and 17B. Thus, a nip Nt is formed between the intermediate transfer belts 16A and 16B clamped by the transferring and fixing rollers 37A and 37B.

The width of the nip Nt can be optionally set as long as the toner images Tmb and Tpb are secondarily transferred onto the sheet S while the sheet S is vertically driven upward. Thus, the mutual pressure between the secondary transfer rollers 37A and 37B is lower than that between the transferring and fixing rollers 17A and 17B.

The position of the intermediate transfer belt 16A in the nip Nt is a first secondary transfer position. The position of the intermediate transfer belt 16B in the nip Nt is a second secondary transfer position.

The inlet guider plate 38 guides the front end of the sheet S which passes the nip Nt and is vertically conveyed upward to the nip NF of the fixing rollers 39A and 39B which are described later.

The fixing roller 39A (39B) fixes the toner image Tmc (Tpc) on the first side P1 (second side P2) of the sheet S. For the fixation, the fixing roller 39A (39B) heats and pressurizes the toner image Tmc (Tpc).

The fixing rollers 39A and 39B are both provided with a metal roller the surface of which is coated with a rubber layer and a heater which emits heat inside the metal roller. The fixing rollers 39A and 39B press each other to form the nip NF. The fixing rollers 39A and 39B are rotated towards opposite directions by drivers (not shown). The fixing rollers 39A and 39B are capable of vertically conveying the sheet S clamped on the nip NF upward.

The rubbers on the surfaces of the fixing rollers 39A and 39B may be equal in hardness. In this case, as the first side P1 and the second P2 of the sheet S are equally pressed, the nip NF is flat. Thus, the sheet S is prevented from curving during a double-side printing process.

The sheets S conveyed by the fixing rollers 39A and 39B are conveyed into the paper discharging guider 25.

Like the heaters of the transferring and fixing rollers 17A and 17B, the heaters in the fixing rollers 39A and 39B heat the nip NF so as to maintain a fixation temperature.

In the foregoing transfer fixer 44, the secondary transfer rollers 37A and 37B and the fixing rollers 39A and 39B are configured adjacent to on the conveyance path of the sheet S.

The secondary transfer rollers 37A and 37B clamp the first side P1 and the second P2 of the sheet S across the intermediate transfer belts 16A and 16B. The secondary transfer rollers 37A and 37B secondarily transfer the toner image Tmb and Tpb onto the sheet S at the same time during double-side printing.

The fixing rollers 39A and 39B synchronously fix the secondarily transferred toner image Tmc and Tpc on the sheet S during double-side printing.

In this way, in the transfer fixer 44, the first and the second secondary transfer positions are separated from the fixation position of the secondarily transferred toner images.

Thus, the image forming apparatus 101 is merely different from the image forming apparatus 100 in a secondary transfer action and a fixation action.

In the transfer fixer 44 of the image forming apparatus 101, a fixation action is orderly carried out from where the secondary transfer action is ended. There is a time difference between the secondary transfer action and the fixation action.

However, the secondary transfer action is synchronously carried out for the first side P1 and the second side P2 at positions opposite to the secondary transfer rollers 37A and 37B. The fixation action is synchronously carried out for the first side P1 and the second side P2 at positions where the fixing rollers 39A and 39B are opposite to each other.

Through the secondary transfer action and the fixation action, the image forming apparatus 101 prints on two sides of the sheet S by causing the sheet S to pass the transfer fixer 44 once. Thus, the image forming apparatus 101 spends as much time in completing double-side printing as in completing single-side printing. In the image forming apparatus 101, the time taken to reverse a sheet S one side of which is printed is saved. Thus, the time spent by the image forming apparatus 101 in completing double-side printing is half of that spent by the image forming apparatus 100 in the case where a sheet S passes a fixer twice.

Further, in the image forming apparatus 101, opposite transfer voltages are applied to the second transfer rollers 37A and 37B in the secondary transfer action, which achieves the same effect as in the first embodiment. That is, the toner image Tmb is transferred by a repulsive force from the secondary transfer roller 37A in combination with an attractive force from the secondary transfer roller 37B. The toner image Tpb is transferred by a repulsive force from the secondary transfer roller 37B in combination with an attractive force from the secondary transfer roller 37A.

Thus, the toner images Tmb and Tpb can be secondarily transferred effectively, thus preventing an uneven transfer.

Further, the secondary transfer rollers 37A and 37B are symmetrical with respect to a plane across the sheet S. Thus, in the secondary transfer action, the pressures and the electric fields generated during the period the sheet S passes the secondary transfer rollers 37A and 37B are symmetrical by taking the sheet S as a symmetry plane. As a result, the sheet S is hardly conveyed in a disordered direction after the secondary transfer, thus preventing the sheet S from shaking with respect to the nip NF of the fixing rollers 39A and 39B and guaranteeing the entrance of the sheet S into the substantially center part of the inlet guider plate 38. Consequentially, the friction of the non-transferred toner is prevented.

Further, the image forming apparatus 101 carries out the same actions with the image forming apparatus 100 in the single-side printing. Like the image forming apparatus 100, the image forming apparatus 101 stops the image forming section 4B during single-side printing. Thus, less power is consumed in single-side printing than in double-side printing.

Variations of the foregoing embodiments are described below.

In each foregoing embodiment, the image forming sections 4A and 4B separately form a monochrome image. However, a plurality of image forming sections 4A and a plurality of primary transfer rollers 13A may be separately arranged along the intermediate transfer belt 16A. In this case, multicolor toner images can be formed by changing the color of each toner. For example, a full-color toner image can be formed by forming toner images of four colors of yellow, magenta, cyan and black.

If a plurality of image forming sections 4B and a plurality of primary transfer rollers 13B are separately arranged on the intermediate transfer belt 16B, then a multicolor or a full-color image can also be formed in double-side printing.

It is described in each foregoing embodiment that the relative position relations among the exposure position, the primary transfer position and the secondary transfer position are the same. However, if the front ends of the image forming ranges on both sides of a sheet can reach a first and a second secondary transfer position at the same time, then the exposure position and each first primary transfer position may be different on different paths.

In accordance with at least one of the foregoing embodiments, an image forming apparatus comprises: a first image forming unit, a second image forming unit, a first intermediate transfer belt and a second intermediate transfer belt. The first image forming unit forms a first toner image with negative charges. The second image forming unit forms a second toner image with positive charges. The first intermediate transfer belt and the second intermediate transfer belt are opposite to each other at a first secondary transfer position and a second secondary transfer position. Further, the image forming apparatus comprises: a transfer fixer configured to transfer and fix the toner images on the first side and the second side of a sheet at a first transfer position and a second transfer position. Thus, the image forming apparatus can print on two sides of the sheet by causing the sheet to pass the transfer fixer once. The image forming apparatus shortens printing time and reduces the power consumed during a fixation process.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first image forming unit configured to form a first toner image with a first toner with negative charges;

a second image forming unit configured to form a second toner image with a second toner with positive charges;

a first intermediate transfer belt formed into an endless belt and configured to primarily transfer the first toner image from the first image forming unit and move the primarily transferred first toner image to a first secondary transfer position;

a second intermediate transfer belt formed into an endless belt opposite to the first intermediate transfer belt and configured to primarily transfer the second toner image from the second image forming unit and move the primarily transferred second toner image to a second secondary transfer position opposite to the first secondary transfer position;

a conveyance unit configured to convey a sheet between the first secondary transfer position and the second secondary transfer position; and a transfer fixer configured to secondarily transfer the first toner image on the first intermediate transfer belt onto a first side of the sheet at the first secondary transfer position and fix the first toner image transferred to the first side of the sheet while secondarily transferring the second toner image on the second intermediate transfer belt onto a second side of the sheet opposite to the first side at the second secondary transfer position and fixing the second toner image transferred to the second side of the sheet.

2. The image forming apparatus according to claim 1, wherein the transfer fixer comprises:

a first transferring and fixing roller configured at the inner side of the first intermediate transfer belt at the first secondary transfer position to secondarily transfer the first toner image onto the first side of the sheet while pressing and heating the first toner image onto the first side of the sheet across the first intermediate transfer belt; and a second transferring and fixing roller configured at the inner side of the second intermediate transfer belt at the second secondary transfer position to secondarily transfer the second toner image onto the second side of the sheet while pressing and heating the second toner image onto the second side of the sheet across the second intermediate transfer belt.

3. The image forming apparatus according to claim 2, wherein a negative transfer voltage is applied to the first transferring and fixing roller; and a positive transfer voltage is applied to the second transferring and fixing roller.

4. The image forming apparatus according to claim 2, wherein the first and the second intermediate transfer belts are made from an insulating rubber material; and the first and the second transferring and fixing rollers comprise:

an electrically conductive metal roller; and a heater penetrating the metal roller.

5. The image forming apparatus according to claim 2, wherein to form an image merely on the first side of the sheet, the temperature of the second transferring and fixing roller is reduced to be lower than that of the first transferring and fixing roller; and to form an image merely on the second side of the sheet, the temperature of the first transferring and fixing roller is reduced to be lower than that of the second transferring and fixing roller.

6. The image forming apparatus according to claim 1, wherein the first and the second secondary transfer positions are opposite to each other in the horizontal direction; and the conveyance unit vertically conveys the sheet upward towards the position between the first secondary transfer position and the second secondary transfer position.

7. The image forming apparatus according to claim 6, wherein to form an image on a single side of the sheet, the first toner image formed by the first image forming unit is transferred and fixed on the first side of the sheet.

8. The image forming apparatus according to claim 1, wherein a first primary transfer roller is arranged at the inner side of the first intermediate transfer belt and applied with a positive transfer voltage to primarily transfer the first toner image formed by the first image forming unit onto the first intermediate transfer belt; and a second primary transfer roller is arranged at the inner side of the second intermediate transfer belt and applied with a negative transfer voltage to primarily transfer the second toner image formed by the second image forming unit onto the second intermediate transfer belt.

9. The image forming apparatus according to claim 1, wherein the first image forming unit is provided with a first photoconductive drum with negative charges; and the second image forming unit is provided with a second photoconductive drum with positive charges.

10. An image forming method, comprising:

forming a first toner image with a first toner with negative charges;

forming a second toner image with a second toner with positive charges;

primarily transferring the first toner image onto a first intermediate transfer belt and moving the primarily transferred first toner image to a first secondary transfer position of the first intermediate transfer belt;

primarily transferring the second toner image onto a second intermediate transfer belt and moving the primarily transferred second toner image to a second secondary transfer position of the second intermediate transfer belt;

conveying a sheet between the first secondary transfer position and the second secondary transfer position; and secondarily transferring the first toner image on the first intermediate transfer belt onto a first side of the sheet at the first secondary transfer position and fixing the first toner image transferred to the first side of the sheet while secondarily transferring the second toner image on the second intermediate transfer belt onto a second side of the sheet at the second secondary transfer position and fixing the second toner image transferred to the second side of the sheet.

* * * * *